US005623780A

United States Patent [19]

Phillips, Jr.

[11] Patent Number: 5,623,780

[45] Date of Patent: Apr. 29, 1997

[54] BORE FOR WEAPONS

[75] Inventor: Jonathan W. Phillips, Jr., Hitchcock, Tex.

[73] Assignee: Phillips and Rodgers, Inc., Conroe, Tex.

[21] Appl. No.: 607,712

[22] Filed: Feb. 27, 1996

[51] Int. Cl.[6] ..... F41A 21/12

[52] U.S. Cl. ..... 42/76.01; 89/14.05

[58] Field of Search ..... 89/14.05, 15, 16; 42/76.01, 76.02, 78, 68

[56] References Cited

U.S. PATENT DOCUMENTS

| | | | |
|---|---|---|---|
| 1,470,591 | 10/1923 | Behar | 89/14.05 |
| 2,952,089 | 9/1960 | Maier et al. | 42/76.01 |
| 2,972,800 | 2/1961 | Sterba et al. | 42/76.01 |
| 2,992,596 | 7/1961 | Hammer | 89/16 |
| 3,034,407 | 5/1962 | Darsie | 89/14.05 |
| 3,136,084 | 6/1964 | Charron | 42/76.01 |
| 4,168,589 | 9/1979 | Tiritilli | 42/68 |
| 4,543,741 | 10/1985 | Phillips, Jr. | 42/68 |
| 5,341,587 | 8/1994 | Phillips, Jr. | 42/68 |

FOREIGN PATENT DOCUMENTS

| | | | |
|---|---|---|---|
| 2542076 | 9/1984 | France | 42/76.01 |

*Primary Examiner*—Stephen M. Johnson

*Attorney, Agent, or Firm*—Pravel, Hewitt, Kimball & Krieger

[57] ABSTRACT

A cartridge in a weapon capable of firing several different calibers is provided. The cartridge bore is adapted for use in weapons having extractor and positioner mechanisms which permit use of different caliber casings in the same weapon. With the cartridge bore according to the present invention, casings are more easily removed after firing and are less likely to stick.

6 Claims, 1 Drawing Sheet

BORE FOR WEAPONS

BACKGROUND OF INVENTION

1. Field of Invention

The present invention relates to weapons, more particularly to cartridge bores for weapons adapted to fire different calibers.

2. Description of Prior Art

U.S. Pat. Nos. 4,543,741 and 5,341,587 of which Applicant is inventor, provided ejector and cartridge positioner mechanisms which permit weapons to fire any of several different caliber cartridges. The ejector and positioner mechanisms of these types provided structure for engaging the rear portion of cartridges to enhance the positioning and extraction functions. These types of mechanisms provided structure for proper seating both rimmed and rimless cartridges in the rear of weapon cylinders, while also making the cartridges more easy to load.

Problems existed, however, with forward portions of the cartridges in weapons of this type. It was typical to provide stepped surfaces along the interior cylinder walls to allow proper acceptance and seating of the cartridges. With stepped cylinder walls, the cartridge casing material, which was typically of brass, would be forced against the step surfaces during use as the weapon was fired. If pressures were sufficiently high, the brass material could even flow to some extent. Thus, in certain instances the cartridge casing might tend to stick or resist extraction after firing. The cartridge could be removed relatively easily, but extraction and reloading times would be considerably slowed.

Portions of the cartridge case in some instances after use in stepped cylinders would enlarge. The enlargement could be to such an extent due to high pressure flow that the cartridge case became unsuitable for further reloading. In some additional cases with step surfaces in the cylinder walls, the cartridge case could shear or split or burst as a result of high pressure flow.

SUMMARY OF INVENTION

Briefly, the present invention provides a new and improved cartridge bore structure for a firearm. The cartridge bore structure of the present invention is provided in a weapon having an ejector and cartridge positioner mechanism capable of firing different calibers of cartridges from the weapon. An improved cartridge bore formed in the weapon according to the present invention includes a rim seating portion for seating cartridges having rims. The rim seating portion has a length along a longitudinal axis of said cartridge bore which is equal to the thickness of the widest cartridge rim of a cartridge to be fired from the weapon. The rim seating portion also has a cylindrical surface with an inner diameter larger than the outer diameter of the largest cartridge rim to be fired from the weapon. The cartridge bore structure according to the present invention also includes a first taper segment inwardly of the rim seating portion. The first taper segment forms an outer wall of the cartridge bore extending inwardly along its longitudinal axis. The first taper segments extends inwardly from the rim seating portion a distance substantially equal to the length of the longest cartridge to be fired from the weapon. The first taper segment outer wall also has an inner diameter at a rear portion adjacent the rim seating portion substantially equal to the largest cartridge casing cylinder to be fired from the weapon. According to the present invention, the first tapers segment outer wall taper inwardly along the distance of its inner extent about one percent per unit length.

Inwardly from the first taper segment, the cartridge bore structure includes a second taper segment. The second taper segment forms an outer wall of the cartridge bore extending inwardly from said first taper segment to a forward end of the cartridge bore. The second taper segment has an inner diameter at a rear portion at a juncture with the first taper segment which equals or matches the diameter of the first taper segment at such juncture. With the present invention, the second taper segment outer wall tapers inwardly along its inner extent about five percent per unit length.

According to the present invention, it has been found that a cartridge bore structure so formed permits firing of several different calibers of cartridge in the same weapon. This can be done while reducing the tendency of the cartridge casings to stick and also making removal of the casings after firing more easy to perform.

DESCRIPTION OF PREFERRED EMBODIMENT

Figure 1:
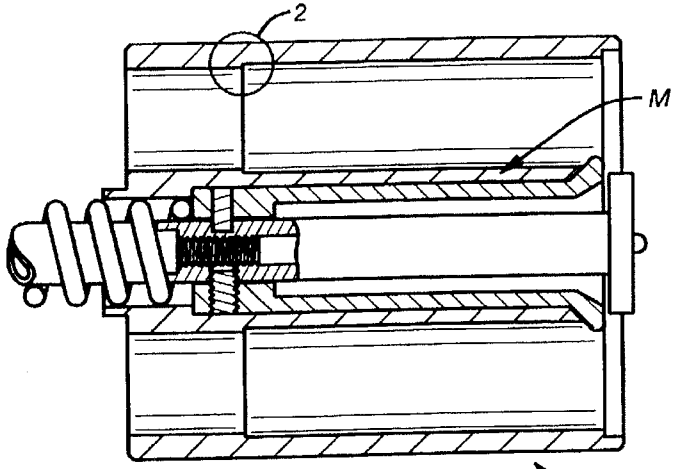
(PRIOR ART) FIG. 1
FIG. 1 is an elevation view taken partly in cross-section of a prior art revolver cylinder with cartridge bores having stepped surface walls.

In the drawings, a revolver cylinder body B according to the prior art (FIG. 1) is shown. The prior art revolver cylinder body B has a cartridge or casing ejector/cartridge positioner mechanism M fitted therein. The mechanism M, for example, may be of the type shown in U.S. Pat. No. 5,341,587 of which applicant is inventor. A cylinder body B of this type with the ejector/cartridge positioner mechanism M is capable of firing cartridges of different calibers, both rimmed and rimless, even from a single load of such cartridges into the cylinder body B. Reference is made to applicant's prior U.S. Pat. 5,341,587 and 4,543,741 for further details of the operation and structure of typical examples of such revolver cylinder bodies.

Figure 2:
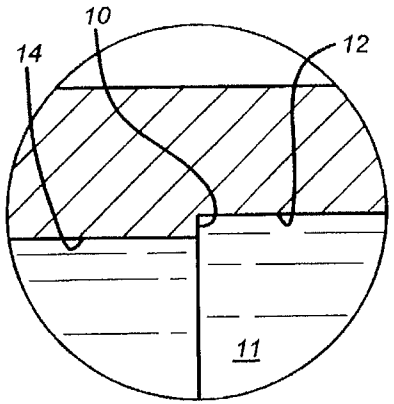
(PRIOR ART) FIG. 2
FIG. 2 is an enlarged view of a portion of the structure of FIG. 1 circled and having reference numeral 2 designating same.

In the revolver cylinder bodies of the prior art, it has been conventional practice to have one or more stepped surfaces one of which is shown in the drawings at reference numeral 10 (FIG. 2) at selected positions along the length of each revolver cylinder bore. The stepped surfaces 10 allow more close engagement with and accommodate cartridges or casings of various diameters. Typically, the stepped surface or surfaces 10 are located at positions along the length of the revolver cylinder bore 11. The example stepped surface 10 is shown in FIG. 2 in somewhat enlarged scale between a first cylinder bore wall portion 12 of a first inner diameter along its length and a second cylinder bore wall portion 14 of another, smaller inner diameter along its length.

There were several problems with revolver cylinder bores with stepped surfaces 10 of this type. If several of such stepped surfaces were to be provided in a cylinder bore for each of several calibers, manufacturing costs and complexity for this type of revolver cylinder body were greatly increased. If stepped surfaces were provided for only certain calibers to reduce costs and complexity, the adaptability and versatility of the weapon for use with a variety of casing or cartridge sizes was significantly reduced.

Further, even if only one set of stepped surfaces, as that exemplified at 10, was provided in the revolver cylinder body B, problems resulting from casing material flow were present as has been detailed above. These problems included extraction or unloading problems, reloading problems and even possible problems of casing rupture or breakage in certain situations.

Figure 4:
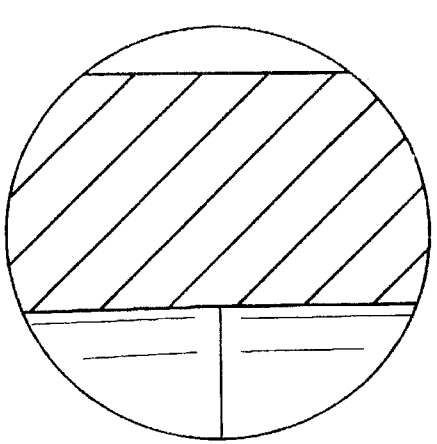
FIG. 4 is an enlarged view of a portion of the structure of FIG. 3 circled and having reference numeral 4 designating same.
Figure 3:
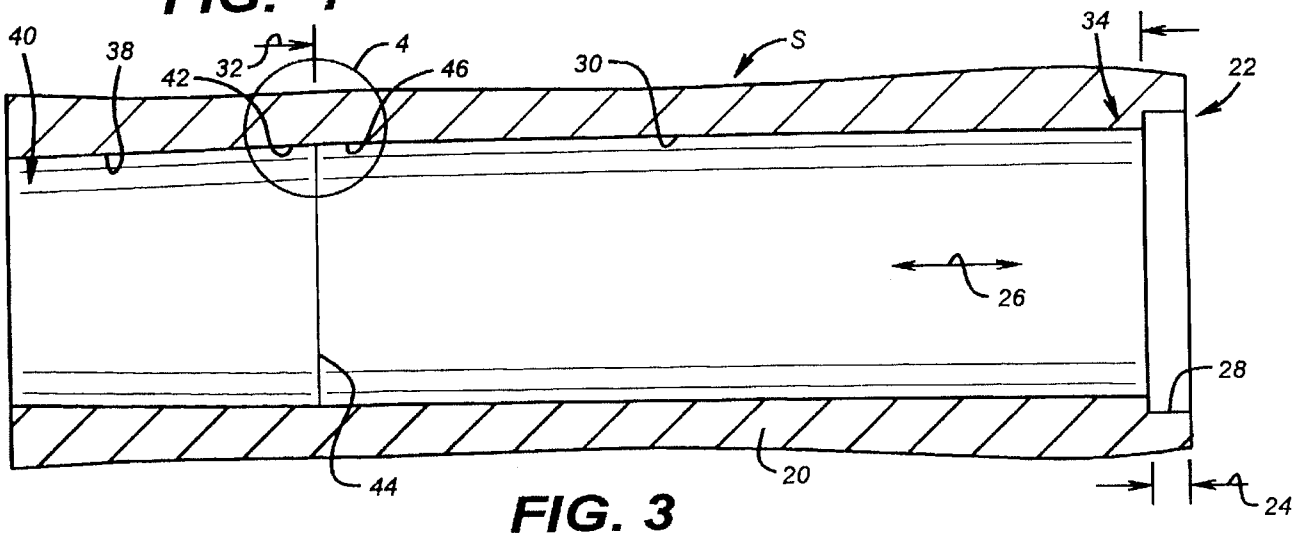
FIG. 3 is a cross-sectional view of a cartridge bore for a weapon according to the present invention.

With the present invention, a new and improved cartridge bore structure S (FIGS. 3 & 4) for a firearm is provided. The cartridge bore structure S of the present invention is provided in a body portion 20 of weapon having an ejector and cartridge positioner mechanism capable of firing different calibers of cartridges from the weapon. It should be understood that the weapon may also be some other type of a firearm, which may be another form of revolver cylinder body, a carbine, an automatic pistol or the like, capable of firing different calibers of cartridges.

An improved cartridge bore structure S formed in the weapon according to the present invention includes a rim seating portion 22 for seating cartridges having rims. The rim seating portion 22 has a length 24 along a longitudinal axis, indicated by an arrow 26, of the cartridge bore structure S which is equal to the thickness of the widest cartridge rim of a cartridge to be fired from the weapon. The rim seating portion 22 also has a cylindrical surface 28 with an inner diameter larger than the outer diameter of the largest cartridge rim to be fired from the weapon.

The cartridge bore structure S according to the present invention also includes a first taper segment 30 inwardly of the rim seating portion 22. The first taper segment 30 forms an outer wall of the cartridge bore S extending inwardly along its longitudinal axis 26. The first taper segment 30 extends inwardly from the rim seating portion 22 a distance as indicated at 32 substantially equal to the length of the longest cartridge to be fired from the weapon. The outer wall of the first taper segment 30 also has an inner diameter at a rear portion 34 adjacent the rim seating portion 22 substantially equal to the largest cartridge casing cylinder to be fired from the weapon. According to the present invention, the first taper segment outer wall taper S inwardly along the distance of its inner extent about one percent per unit length.

Thus, for example, a cartridge bore structure formed in a revolver capable of firing different caliber shells would have a rim seating portion 22 having a nominal inner diameter of 0.44" and a nominal length of 0.06". The inner diameter of the first taper segment 30 at its rear portion 34 adjacent the rim seating portion 22 measures a nominal 0.393".

Inwardly from the first taper segment 30, the cartridge bore structure S includes a second taper segment 38. The second taper segment 38 forms an outer wall of the cartridge bore S extending inwardly from the first taper segment to a forward end 40 of the cartridge bore S. The second taper segment 38 has an inner diameter at a rear portion 42 at a juncture 44 with a forward portion 46 of the first taper segment 30 which equals or matches the diameter of the first taper segment 30 at such juncture. With the present invention, the second taper segment outer wall tapers inwardly along its inner extent about five percent per unit length. Accordingly, for a cartridge bore structure first taper 30 having a segment rear portion 34 with an inner diameter of 0.393", the juncture 44 of its forward portion 46 with the second taper segment 38 is located 1.25" inwardly from the rear portion 34. At the juncture 44, the forward portion 46 has a nominal inner diameter of 0.381". The taper of the first taper segment 20 is thus a nominal 0.012"/1.25" or about one percent (1%) per unit length. Manufacturing tolerances typically allow some minor variation of ±0.006" in the inner diameters of the taper segment 20 between rear portion 34 and forward portion 46.

The second taper segment 38 has a like inner diameter of 0.381" at the juncture 44 with first taper segment 20. The second taper segment 38 extends inwardly along the longitudinal axis 26 for a distance of 0.443" to the forward end 40 of the cartridge bore structure S. At the forward end 40, the second taper segment 30 has an inner diameter of 0.359". The taper of the second taper segment 30 is thus a nominal 0.022"/0.443" or five percent (5%) per unit length. Manufacturing tolerances typically allow some minor variation of ±0.003" in the taper of second segment 30 between the juncture 44 and the forward end 40.

According to the present invention, it has been found that a cartridge bore structure S so formed permits firing of several different calibers of cartridge in the same weapon with high accuracy. This can be done while reducing the tendency of the cartridge casings to stick and also making removal of the casings after firing more easy to perform. The cartridge casings are better adapted for subsequent reloading use. Potential rupture hazards are also reduced.

Having described the invention above, various modifications of the techniques, procedures, material and equipment will be apparent to those in the art. It is intended that all such variations within the scope and spirit of the appended claims be embraced thereby.

I claim:

1. In a weapon having an ejector and cartridge positioner mechanism capable of firing different calibers of cartridges from the weapon, an improved cartridge bore formed in the weapon, comprising:

a rim seating portion for seating cartridges having rims, said rim seating portion having a length along a longitudinal axis of said cartridge bore equal to the thickness of the widest cartridge rim of a cartridge to be fired from the weapon;

said rim seating portion further having a cylindrical surface with an inner diameter larger than the outer diameter of the largest cartridge rim to be fired from the weapon;

a first taper segment forming an outer wall of the cartridge bore and extending inwardly along the longitudinal axis thereof from said rim seating portion a distance substantially equal to the length of the longest cartridge to be fired from the weapon, said first taper segment outer wall having an inner diameter at a rear portion adjacent said rim seating portion substantially equal to the largest cartridge casing cylinder to be fired from the weapon, said first taper segment outer wall tapering inwardly along said distance of its inner extent about one percent of the diameter of the cartridge bore per unit length of said first taper segment;

a second taper segment formed inwardly of said first taper segment and forming an outer wall of the cartridge bore, said second taper segment extending inwardly from said first taper segment to a forward end of the cartridge bore, said second taper segment having an inner diameter at a rear portion at a juncture with said first taper segment matching the diameter of said first taper segment at said juncture, said second taper segment outer wall tapering inwardly along its inner extent about five percent of the diameter of the cartridge bore per unit length of said second taper segment.

2. The weapon of claim 1, wherein said first taper segment outer wall tapers inwardly along said distance of its inner extent an amount nominally equal to 0.96 percent Of the diameter of the cartridge bore per unit length of said first taper segment.

3. The weapon of claim 1, wherein said first taper segment outer wall tapers inwardly along said distance of its inner extent an amount from about 0.9 to about 1.01 percent of the diameter Of the cartridge bore per unit length of said first taper segment.

4. The weapon of claim 1, wherein said second taper segment outer wall tapers inwardly along said distance of its inner extent an amount nominally equal to 4.96 percent of the diameter of the cartridge bore per unit length of said second taper segment.

5. The weapon of claim 1, wherein said second taper segment outer wall tapers inwardly along said distance of its inner extent an amount from about 4.89 to about 5.04 percent of the diameter of the cartridge bore per unit length of said second taper segment.

6. The structure of claim 1, wherein said weapon is a revolver and said cartridge bore is formed in a cylinder in said revolver.

* * * * *